US006515588B1

(12) United States Patent
Sarabia

(10) Patent No.: US 6,515,588 B1
(45) Date of Patent: Feb. 4, 2003

(54) MONITORING AND ALERTING SYSTEM FOR LUGGAGE

(76) Inventor: Ricardo Sarabia, 6116 Passons Blvd., Pico Rivera, CA (US) 90660

( * ) Notice: Subject to any disclaimer, the term of this patent is extended or adjusted under 35 U.S.C. 154(b) by 0 days.

(21) Appl. No.: 09/950,202

(22) Filed: Sep. 10, 2001

Related U.S. Application Data

(60) Provisional application No. 60/127,049, filed on Mar. 31, 1999.

(51) Int. Cl.[7] ..... G08B 13/14

(52) U.S. Cl. ..... 340/568.1; 340/539; 340/568.7; 340/686.1; 340/686.6; 340/691.1; 340/693.5; 340/571; 340/693.6

(58) Field of Search ..... 340/572.2, 539, 340/568.1, 598.7, 686.1, 686.6, 691.1, 693.5, 571 AR, 693.6

(56) References Cited

U.S. PATENT DOCUMENTS 4,593,273 A * 6/1986 Narcisse ..... 340/539

5,223,815 A * 6/1993 Rosenthal et al. ..... 340/539

* cited by examiner

*Primary Examiner*—Daniel J. Wu
*Assistant Examiner*—Tai T. Nguyen
(74) *Attorney, Agent, or Firm*—Goldstein & Lavas, P.C.

(57) ABSTRACT

A monitoring and alerting system for luggage including a master unit and a plurality of slave units. Each slave unit has a unique identity. The master unit and slave units each have a status display having numbered indicia which normally displays the numbered indicia for the slave units in a first color, and has an annunciator. When the master unit and slave units are separated by a predetermined distance, an alert condition is established whereby the numbered indicia for that slave unit changes to a second color and both the master unit and slave unit sound an alert with their annunciators. A wire loop may be used to attach the slave units to luggage, which normally maintains a closed circuit, such that if the wire loop is removed from the luggage and becomes open circuited while the slave unit is on, the alert condition is established.

7 Claims, 5 Drawing Sheets

MONITORING AND ALERTING SYSTEM FOR LUGGAGE

CROSS REFERENCES AND RELATED SUBJECT MATTER

This application relates to subject matter contained in provisional patent application Ser. No. 60/127,049, filed in the United States Patent & Trademark Office on Mar. 31, 1999, and subject matter contained in utility patent application Ser. No. 09/541,275, filed in the United States Patent & Trademark Office on Apr. 1, 2000.

BACKGROUND OF THE INVENTION

The present invention relates to a monitoring and alerting system for luggage and more particularly pertains to alerting an individual that their luggage is being moved without their consent.

The theft of luggage from airports and other heavy traffic areas has become a more frequent occurrence. Many travelers carry multiple pieces of luggage with them while they are traveling. Often, they cannot keep their eyes on each piece of luggage they have at all times. Thus, it becomes easy for a thief to walk away with the traveler's luggage.

The present invention seeks to provide a means of alerting a traveler that their luggage beyond a predetermined range from them whereby an audible and visual alert would be triggered at both the traveler and the luggage when the traveler is separated, to stop the theft from continuing.

To some extent, the use of monitoring devices is known in the prior art. More specifically, monitoring devices heretofore devised and utilized for the purpose of monitoring the location of personal belongings are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,598,272 to Cox discloses a device capable of monitoring an article or child, and sounding an alarm if a threshold distance is exceeded. U.S. Pat. No. 5,661,460 to Sallen discloses a system for monitoring the distance between a parent unit and child unit by change in phase of a reference RF signal. U.S. Pat. No. 5,640,144 to Russo discloses a device for the prevention of the loss of an article, comprised of an ultrasonic transmitter capable of triggering an alarm if a predetermined distance is exceeded. U.S. Pat. No. 5,214,410 to Verster discloses a system for locating a number of objects using a plurality of label-like transponders. U.S. Pat. No. 5,617,074 to White discloses a transmitter concealingly attached to a child for locating lost children.

U.S. Pat. No. 5,629,677 to Staino, Jr. discloses an apparatus for locating a pair of eyeglasses. However, Staino provides a locating signal "upon the manual activation of the signaling mechanism". Thus, Staino would not automatically notify the user that the eyeglasses have been separated from the owner, unless the owner is already looking for them.

U.S. Pat. No. 5,402,104 to LaRosa discloses a scanning excessive separation alarm. However, LaRosa provides no mechanism for determining that a wrongdoer has removed its asset protection transponder from the item of personal property. Thus, LaRosa will not sound an alarm if the thief detaches the transponder from the property and removes the property.

While these devices fulfill their respective, particular objective and requirements, the aforementioned patents do not describe a monitoring and alerting system for luggage for alerting an individual that their luggage is being moved without their consent.

In this respect, the monitoring and alerting system for luggage according to the present invention substantially departs from the conventional concepts and designs of the prior art, and in doing so provides an apparatus primarily developed for the purpose of alerting an individual that their luggage is being moved without their consent.

Therefore, it can be appreciated that there exists a continuing need for new and improved monitoring and alerting system for luggage which can be used for alerting an individual that their luggage is being moved without their consent. In this regard, the present invention substantially fulfills this need.

SUMMARY OF THE INVENTION

In the view of the foregoing disadvantages inherent in the known types of people monitoring devices now present in the prior art, the present invention provides an improved monitoring and alerting system for luggage. As such, the general purpose of the present invention, which will be described subsequently in greater detail, is to provide a new and improved monitoring and alerting system for luggage and method which has all the advantages of the prior art and none of the disadvantages.

To attain this, the present invention essentially comprises a monitoring and alerting system for luggage including a master unit and a plurality of slave units. Each slave unit has a unique identity. The master unit and slave units each have a status display having numbered indicia which normally displays the numbered indicia for the slave units in a first color, and has an annunciator. When the master unit and slave units are separated by a predetermined distance, an alert condition is established whereby the numbered indicia for that slave unit changes to a second color and both the master unit and slave unit sound an alert with their annunciators. A wire loop may be used to attach the slave units to luggage, which normally maintains a closed circuit, such that if the wire loop is removed from the luggage and becomes open circuited while the slave unit is on, the alert condition is established.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved monitoring and alerting system for luggage which has all the advantages of the prior art people monitoring devices and none of the disadvantages.

It is another object of the present invention to provide a new and improved monitoring and alerting system for luggage which may be easily and efficiently manufactured and marketed.

It is a further object of the present invention to provide a new and improved monitoring and alerting system for luggage which is of durable and reliable construction.

An even further object of the present invention is to provide a new and improved monitoring and alerting system for luggage which is susceptible of a low cost of manufacture with regard to both materials and labor, and which accordingly is then susceptible of low prices of sale to the consuming public, thereby making such a monitoring and alerting system for luggage economically available to the buying public.

Even still another object of the present invention is to provide a new and improved monitoring and alerting system for luggage for alerting an individual that their luggage is being moved without their consent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to FIGS. 1 through 9 thereof, the preferred embodiment of the new and improved monitoring and alerting system for luggage embodying the principles and concepts of the present invention and generally designated by the reference number 10 will be described.

Specifically, it will be noted in the various Figures that the device relates to a monitoring and alerting system for luggage for alerting an individual that their luggage is being moved without their consent. In its broadest context, the device consists of a master unit 12 and a plurality of slave units 18. Such components are individually configured and correlated with respect to each other so as to attain the desired objective.

Figure 1:
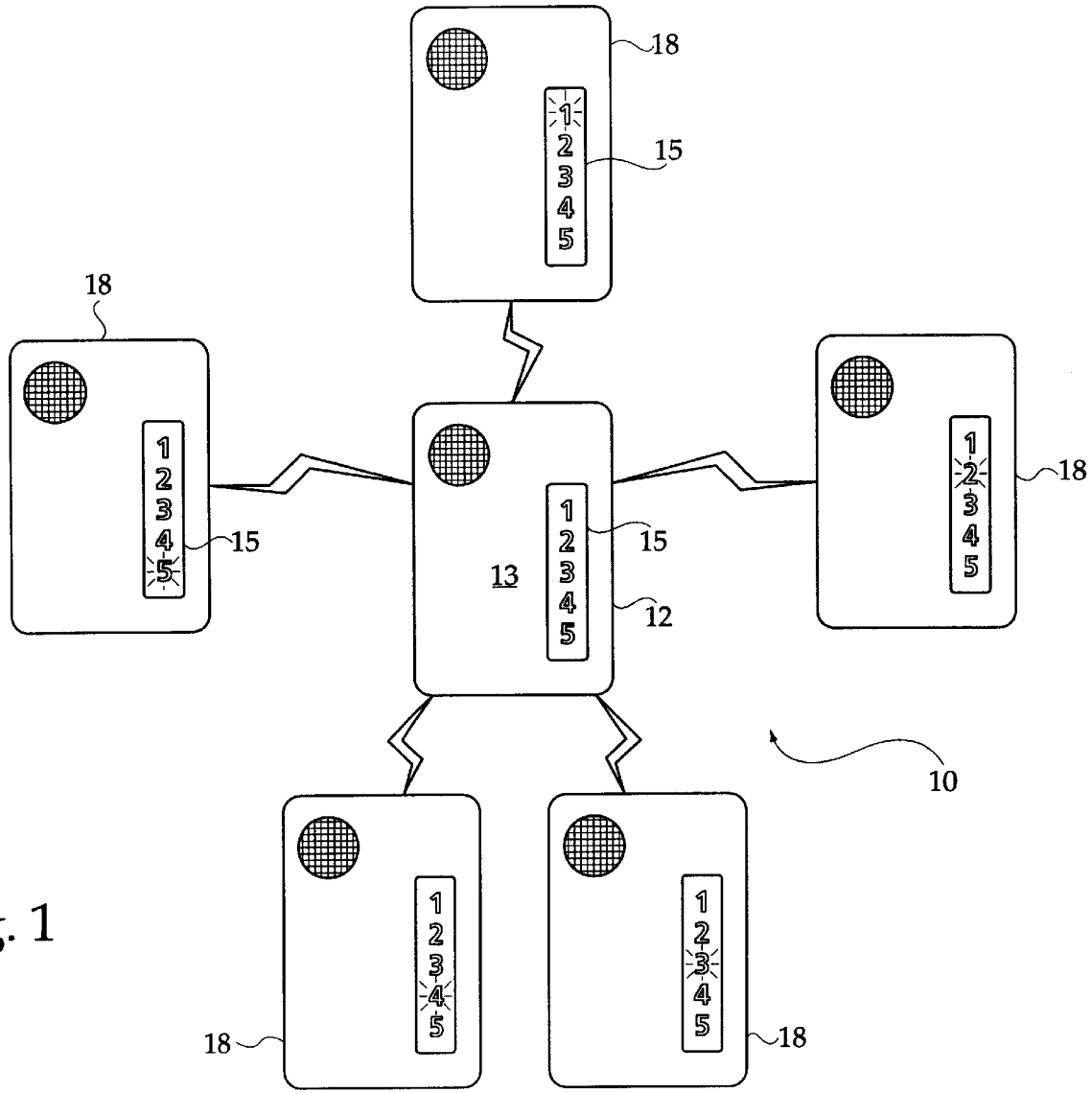
FIG. 1 is an elevational view, indicating a master unit, along with five slave units in communication therewith, according to the present invention.

As illustrated in FIG. 1, the master unit 12 is comprised within a rectangular housing. The master unit 12 has a front face 13, and an annunciator 14 disposed in said front face 13. In addition, a status display 15 is located on the front face 13. Five slave units 18 are in the immediate proximity of the master unit 12, and are in communication therewith. Each of the slave units 18 has a unique identity. Further each of the slave units has its own status display 15, which illuminates the unique identity of that slave unit. In particular, the slave units are numbered "1" through "5". As illustrated in FIG. 1, the status display 15 of each of the slave units appropriately reflects its numbered identity. Provided that the slave unit 18 remains in contact with the master unit 12, the slave unit 18 will display the numbered identity in a first color, which indicates normal operation. Typically, the first color would be green. However, if one of the slave units 18 is separated from the master unit beyond a predetermined distance, which is preferably six feet, the numbered identity on that slave unit 18 will change to a second color, indicating an alert condition. The second color is preferably red. In addition, upon such separation, the status display 15 on the master unit 12 will turn to the second color for that same numbered identity. Thus, if slave unit "2" is separated from the master unit 12, the numbered indicia "2" on both that slave unit and the master unit 12 will change to the second, alert color.

Figure 4:
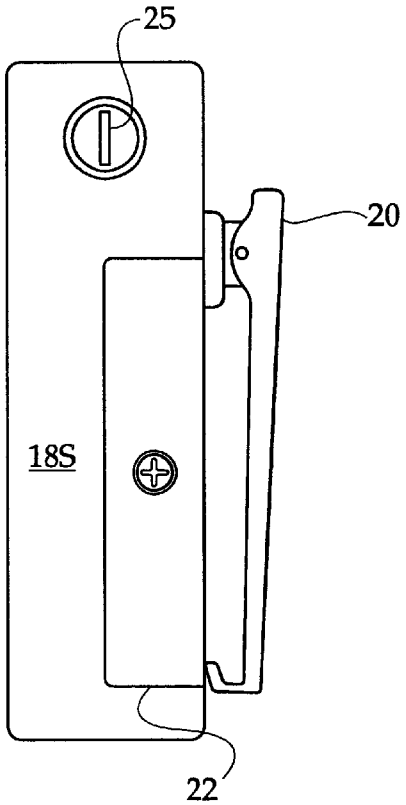
FIG. 4 is a side view of one of the slave units, indicating the key switch which is employed to power the unit on or off.
Figure 3:
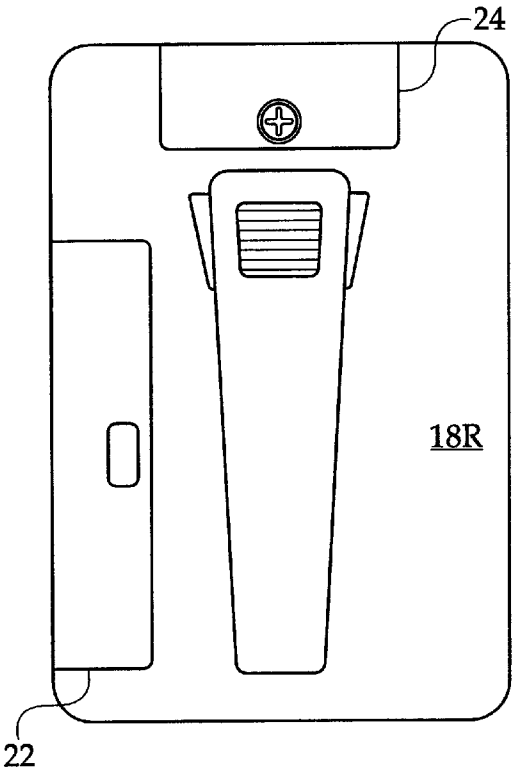
FIG. 3 is a rear view of one of the slave unit of the present invention.
Figure 2:
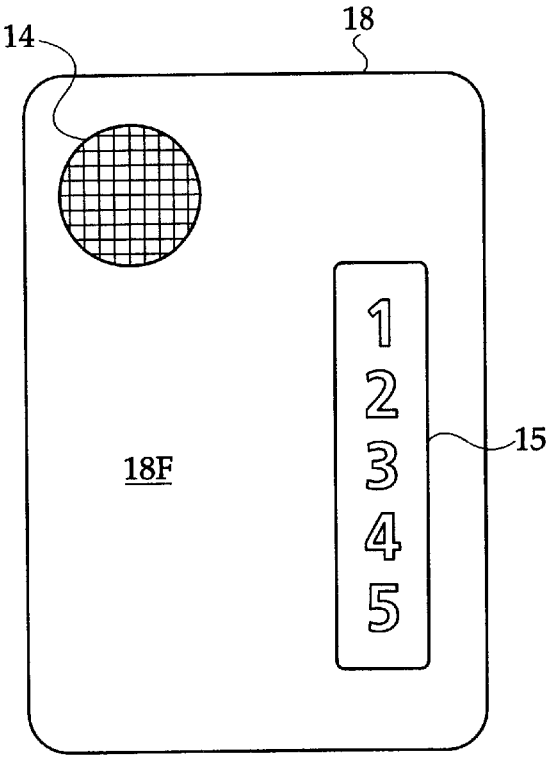
FIG. 2 is a front elevational view of one of the slave units.
Figure 6:
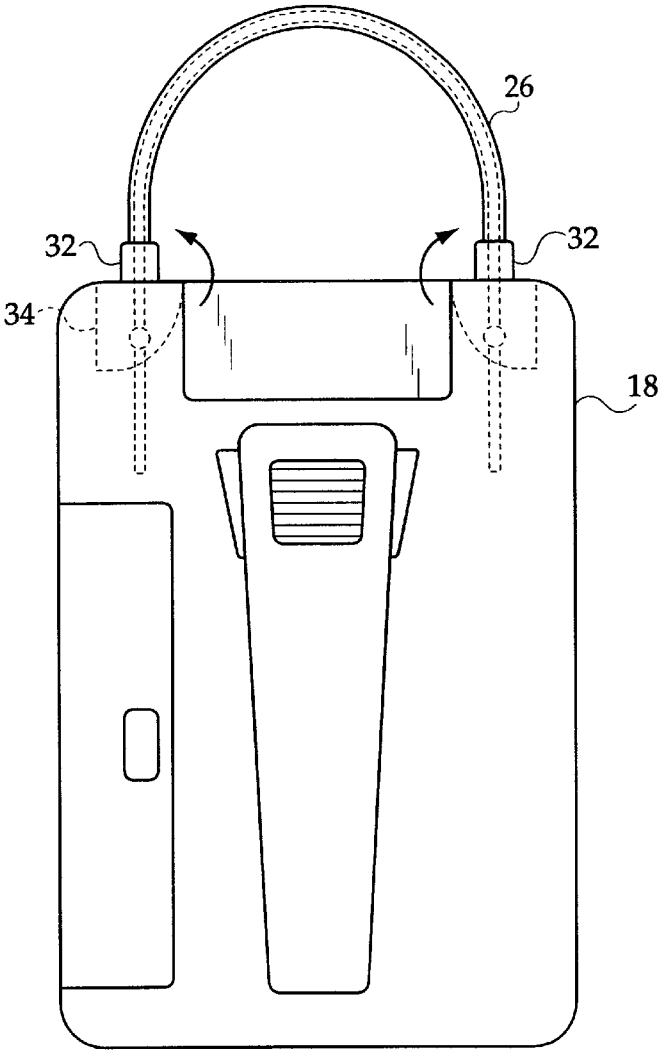
FIG. 6 is a rear elevational view, illustrating the wire loop securing mechanism extended, wherein the wire loop is ready to be attached to an item of luggage.

FIGS. 2, 3, and 4 illustrate one of the slave units 18, illustrating a front 18F, rear 18R and side 18S thereof. As l;I, previously indicated, the status display 15 is located on the front 18F. In addition, a belt clip 20 is located on the rear 18R. Further a battery compartment 22 is typically provided on the side 18S, although its placement has little bearing on the functionality of the present invention. A wire loop storage compartment lid 24 is located on the rear 18R, the purpose of which will be revealed hereinafter. Further, a key switch 25 is located on the side 18S, to allow the user to selectively power the unit 18 on or off.

FIGS. 5, 6, 7, and 8 illustrate a wire loop 26 which is used to attach to luggage and other personal property by extending it through the handle or a similar opening therein. As illustrated, the slave unit 18 has a top 18T and the wire loop 26 may be stored in a wire loop storage compartment 28 indented within the top 18T and rear 18R which is selectively covered by the wire loop storage compartment lid 24. The wire loop 26 is actually connected between a wire loop assembly 30, which includes a pair of wire loop connectors 32, and a pair of wire loop swivels 34. The wire loop swivels 34 each have an outer surface 36 and a dummy surface 38. The wire loop swivels 34 are positioned on opposite sides of the wire loop storage compartment 28, and are each capable of swiveling between a storage position where the outer surfaces 36 extend within the wire loop storage compartment 28 and face each other, and an in-use position where the outer surfaces 36 extend parallel to each other and to the top surface 18T of the slave unit 18.

The wire loop 26 may be disconnected at one of the wire loop connectors 32, allowing the wire loop 26 to extend through the handle, an eyelet, or some other portion of a piece of luggage, at which point the wire loop 26 is reconnected at that wire loop connector 32. When the wire loop 26 is connected between the wire loop connectors 32 an electric circuit is maintained, such that breakage of the electric circuit indicates tampering, and signals an alarm just as if the slave unit 18 were separated from the master unit.

Figure 5:
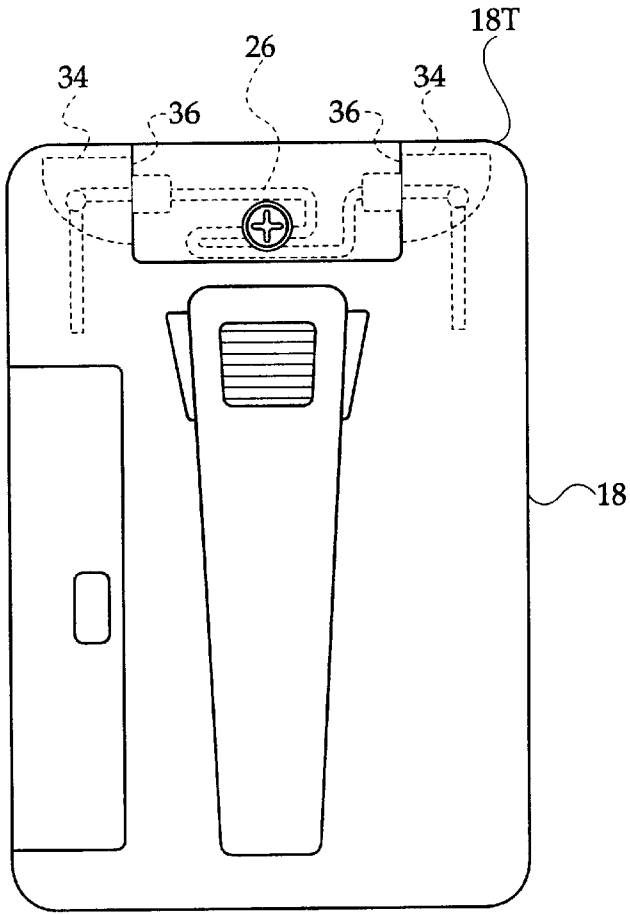
FIG. 5 is a rear elevational view of one of the slave units, illustrating the wire loop securing mechanism, retracted within the slave unit housing.
Figure 8:
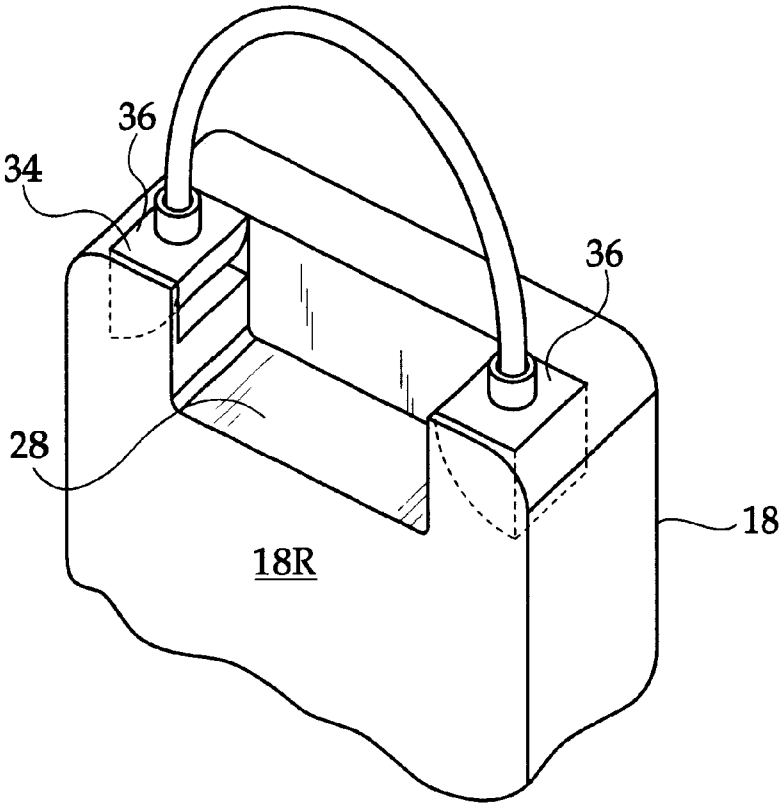
FIG. 8 is a perspective view, illustrating the wire loop securing mechanism extended.
Figure 7:
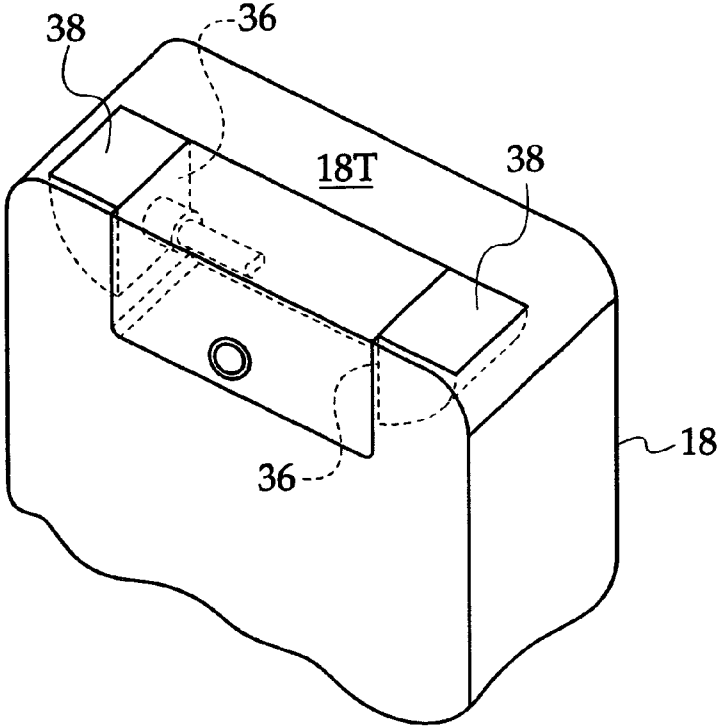
FIG. 7 is a perspective view, illustrating the wire loop securing mechanism, such that the wire loop is concealed within the wire loop compartment.

FIG. 5 and FIG. 7 show the storage position, wherein the outer surface 36 of the wire loop swivels 34 are oriented inward, and the wire loop 26 is folded and concealed within the wire loop storage compartment 28. The wire loop 26 remains in this position between uses.

Figure 9:
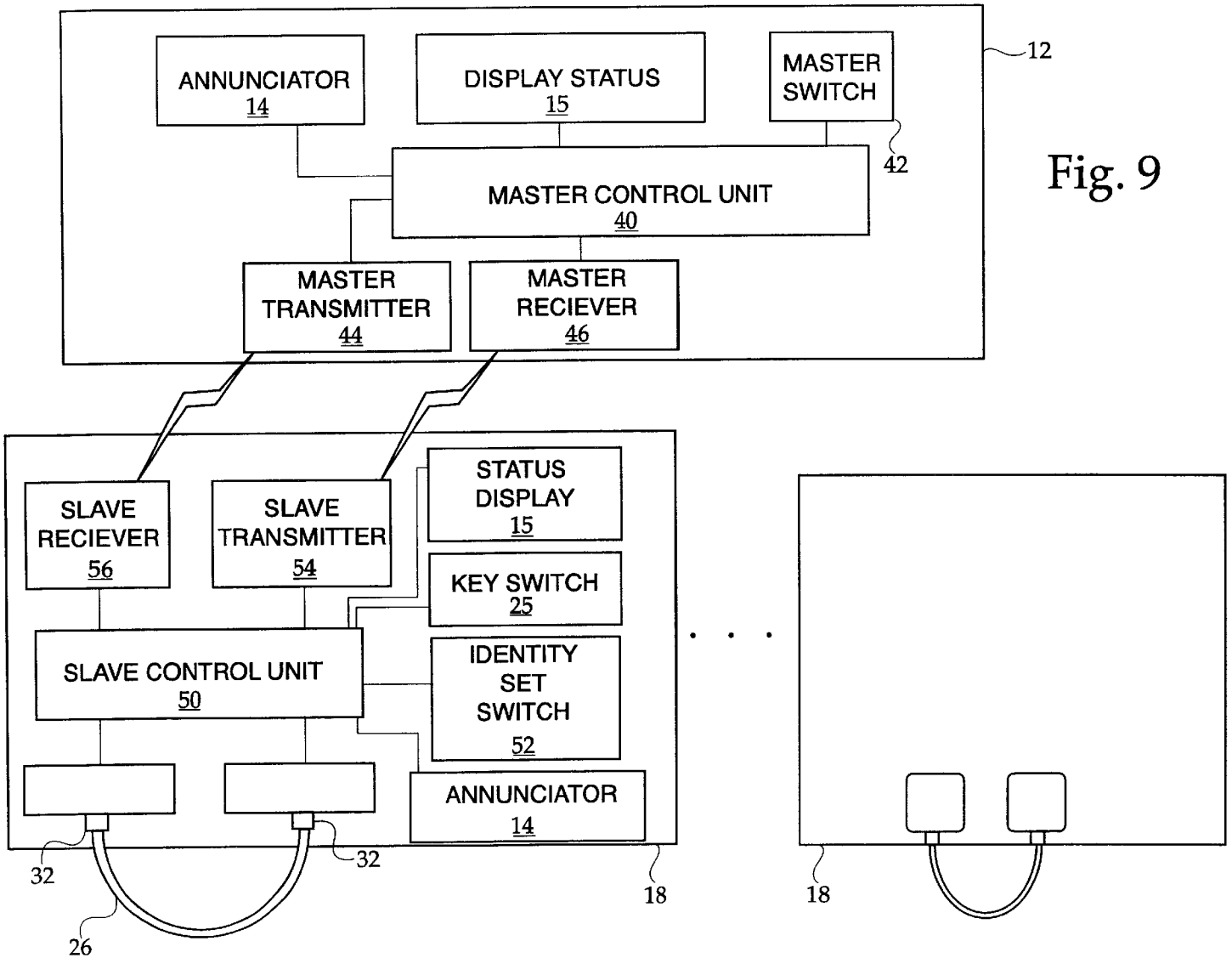
FIG. 9 is a block diagram, illustrating functional components of the master and slave units.

FIG. 9 is a block diagram, illustrating functional interconnection of the various components of the master unit 12 and the slave units 18. In particular, the master unit 12 has a master control unit 40 which provides the overall functionality and coordinates other components of the master unit 12. In particular, the master unit 12 is activated by a master switch 42. Further, the annunciator 14 and the status indicators 15 are in communication with the master control unit 40 to provide an indication to the user of an alert condition, and alternatively, that all slave units 18 are within range. The master unit 12 has a master transmitter 44 and a master receiver 46.

Each of the slave units 18 has a slave control unit 50 An identity set switch 52 allows the unique identity of each of the slave units 18 to be set. The identity set switch 52 can be a set of dip switches, a rotary selector switch, or any other miniature means for allowing the identity of the slave unit to be set. The wire loop connectors 32 are also in communication with the slave control unit 50, such that when the wire loop 26 is properly connected between the connectors 32 the slave control unit 50 will detect a closed circuit. However, if the wire loop 26 does not provide a closed circuit between the connectors 32, and the key switch 25 is in its "on" position, an alert condition will be detected and the annunciator 14 of the slave unit 18 will be enabled.

Further, the slave unit has a slave unit transmitter 54 and a slave unit receiver 56 in communication with the slave control unit 50. During ordinary operation, the slave unit transmitter 54 sends a periodic signal to the master unit receiver 46, with an encoding of the unique identity for that slave unit 18 as set by the identity set switch 52. Provided that the periodic signal is received by the master unit receiver 46, and at the expected signal strength, then ordinary operation continues.

However, if the slave unit 18 is separated from the master unit 12 beyond a predetermined distance, the periodic signal from that slave unit will either fall below its expected signal strength at the master unit receiver 46, or will fail to be detected altogether, indicating an alert condition. In response to the alert condition, the master control unit 40 changes the numbered indicia on its status display 15 for that slave unit 18 to the second color (presumably red), sounds its annunciator 14, and causes the master unit transmitter 44 to send a return signal to the slave unit 18. In response to receipt of the return signal, the slave unit 18 changes its status indicator 15 to the second color, and sounds its annunciator. Thus, both the master unit 12 and slave unit 18 will sound an alert, and change its status display to indicate the separation.

Similarly, when the connectors 32 are open circuited while the key switch 25 is on, the slave transmitter 54 notifies the master unit receiver 46 of the alert condition, causing the master unit to change its status display 15 for the numbered indicia referring to that slave unit to the second color, and to enable the annunciator to sound an alarm.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A monitoring and alerting system for luggage for alerting an individual that their luggage is being moved without their consent comprising, in combination:

a master unit, having a status display having numbered indicia and an annunciator;

a plurality of slave units, each of the slave units having a unique identity, each of the slave units having an annunciator and a status display capable of displaying numbered indicia, the status display of each slave unit normally displays its unique identity in a first color; and wherein when the master unit and one of the slave units are separated beyond a predetermined distance, an alert condition is established whereby the annunciator on that slave unit and on the master units is enabled, and wherein the numbered indicia representing the unique identity of that slave unit changes to a second color on the display units of both the master unit and slave unit.

2. The monitoring and alerting system for luggage as recited in claim 1, wherein each of the slave units has a pair of connectors, and a wire loop selectively attachable between the connectors, such that when the wire loop is attached between the connectors a closed circuit is maintained thereby, and wherein when the connectors become open circuited the alert condition is established.

3. The monitoring and alerting system for luggage as recited in claim 2, wherein the slave units are contained within a housing, the housing having a wire loop storage compartment, the slave units further having a pair of wire loop swivels located on opposite sides of the wire loop storage compartment, each of the wire loop swivels having an outer surface and a dummy surface, each of the wire loop swivels is pivotable between a storage position wherein the outer surfaces face each other and an in-use position where the outer surfaces extend parallel, the connectors are located on the outer surfaces of the swivels, such that the wire loop extending between said connectors may be selectively stored within the wire loop storage compartment when the swivels are in the storage position.

4. The monitoring and alerting system for luggage as recited in claim 3, wherein each of the slave units has an identity set switch which allows the unique identity of that slave unit to be determined, and wherein each of the slave units transmits a periodic signal to the master unit with the unique identity of that slave unit encoded therein.

5. The monitoring and alerting system for luggage as recited in claim 4, wherein each of the slave units has a key switch which may be selectively placed in an on position, and wherein an alert condition is established if the key switch is in the on position while the connectors are open circuited.

6. The monitoring and alerting system for luggage as recited in claim 5, wherein each of the slave units has a belt clip for selectively attaching to a piece of luggage or to a user when not otherwise attached to luggage.

7. The monitoring and alerting system for luggage as recited in claim 6, wherein the predetermined separation distance is substantially six feet.

* * * * *